US006447412B1

(12) United States Patent
Filippini

(10) Patent No.: US 6,447,412 B1
(45) Date of Patent: Sep. 10, 2002

(54) SPORTS RACKET WITH UNDULATIONS IN FRAME INTERIOR SURFACE

(75) Inventor: Rafael G. Filippini, Chula Vista, CA (US)

(73) Assignee: EF Composite Technologies, L.P., San Diego, CA (US)

( * ) Notice: Subject to any disclaimer, the term of this patent is extended or adjusted under 35 U.S.C. 154(b) by 0 days.

(21) Appl. No.: 09/552,342

(22) Filed: Apr. 18, 2000

(51) Int. Cl.[7] ..... A63B 49/02

(52) U.S. Cl. ..... 473/524

(58) Field of Search ..... 473/524, 537, 473/545; D21/729, 730

(56) References Cited

U.S. PATENT DOCUMENTS

| | | | | | |
|---|---|---|---|---|---|
| 1,422,993 | A | * | 7/1922 | Larned | 473/524 X |
| 1,451,836 | A | | 4/1923 | Larned | |
| 1,541,828 | A | | 6/1925 | Larned | |
| 1,588,139 | A | | 6/1926 | Penney | |
| 1,750,727 | A | | 3/1930 | Norton | |
| 2,282,195 | A | | 5/1942 | Compte | |
| 2,626,804 | A | | 1/1953 | Robinson | |
| 3,086,777 | A | | 4/1963 | LaCoste | |
| 3,265,401 | A | | 8/1966 | Spier | |
| 3,568,290 | A | | 3/1971 | Carlton | |
| 3,647,211 | A | | 3/1972 | Doessel et al. | |
| 3,727,295 | A | | 4/1973 | Gildemeister | |
| 3,810,620 | A | | 5/1974 | Decker, III et al | |
| 3,814,423 | A | | 6/1974 | Shockley et al. | |
| 3,833,219 | A | | 9/1974 | Dean | |
| 3,912,268 | A | | 10/1975 | Robinson | |
| 3,947,029 | A | | 3/1976 | Gallagher | |
| 3,949,988 | A | | 4/1976 | Staufer | |
| 3,986,716 | A | | 10/1976 | Taussig et al. | |
| 3,993,308 | A | | 11/1976 | Jenks | |
| 4,005,862 | A | | 2/1977 | Portz et al. | |
| 4,061,520 | A | | 12/1977 | Cecka et al. | |
| 4,066,260 | A | | 1/1978 | Rodgers, Jr. | |
| 4,102,533 | A | | 7/1978 | Ida | |
| 4,165,071 | A | | 8/1979 | Frolow | |
| 4,177,990 | A | | 12/1979 | Kajiwara | |
| 4,185,822 | A | | 1/1980 | Li | |
| 4,205,844 | A | | 6/1980 | Gombas | |
| 4,280,699 | A | | 7/1981 | Drake | |
| 4,365,806 | A | | 12/1982 | Reid et al. | |
| 4,664,380 | A | | 5/1987 | Kuebler | |
| 4,725,059 | A | | 2/1988 | Du Gardin et al. | |
| 4,747,598 | A | | 5/1988 | Curtis | |
| 4,768,786 | A | | 9/1988 | Kuebler | |
| 4,772,021 | A | | 9/1988 | Maynard | |
| 4,793,958 | A | | 12/1988 | Mott | |
| 4,911,444 | A | | 3/1990 | Yoneeyama | |

(List continued on next page.)

FOREIGN PATENT DOCUMENTS

| | | | | |
|---|---|---|---|---|
| EP | 538523 | * | 4/1993 | 473/FOR 171 |
| GB | 2056863 B | | 2/1981 | |
| GB | 2262892 A | | 7/1983 | |
| GB | 2198959 | * | 6/1988 | 473/FOR 171 |
| GB | 2203653 | * | 10/1988 | 473/FOR 181 |
| WO | 94/00203 | * | 1/1994 | 473/FOR 171 |

*Primary Examiner*—Raleigh W. Chiu
(74) *Attorney, Agent, or Firm*—Piper Rudnick; Jefferson Perkins

(57) ABSTRACT

A sports racquet comprises a handle and a frame coupled to the handle. The frame includes an inner portion and an outer portion located substantially opposite the inner portion. The inner portion of the frame include a plurality of undulations that extend towards and away from a ball-hitting surface, the undulations reducing the unintended bunching and wrinkling of material that intermittently forms in the frame during the manufacturing process. The undulations can be varied by location, undulation length, undulation height, and frequency and can be used in racquets made from a variety of materials and methods.

14 Claims, 12 Drawing Sheets

U.S. PATENT DOCUMENTS 4,919,438 A 4/1990 Yoneeyama
4,935,185 A 6/1990 Moff
5,009,422 A 4/1991 Soong
5,037,098 A 8/1991 Davis
5,082,266 A * 1/1992 Lo ..... 473/537
5,183,265 A 2/1993 Umlauft et al.
5,197,731 A 3/1993 Svoma et al
5,306,004 A 4/1994 Soong
5,306,005 A * 4/1994 Lacoste et al. ..... 473/537 X
5,310,180 A 5/1994 Wu
5,312,115 A 5/1994 Wu
5,386,991 A 2/1995 Roehette
5,462,274 A * 10/1995 Takatsuka ..... 473/537
5,538,243 A 7/1996 Yamamoto et al
5,573,242 A 11/1996 Yoo

* cited by examiner

SPORTS RACKET WITH UNDULATIONS IN FRAME INTERIOR SURFACE

TECHNICAL FIELD

This invention relates generally to sports racquets. More particularly, this invention relates to a sports racquet with undulations in the interior surface of the frame for increasing the overall strength, durability and stiffness of the racquet.

BACKGROUND OF THE INVENTION

Racquets for sports such as tennis, racquetball, squash and badminton are well known in the art and by the public. Many currently existing racquets include a tubular frame made of a composite or other material which surrounds a string bed, with the string bed serving as the hitting surface for the racquet.

Although such racquets have many beneficial qualities, they also have drawbacks which this invention addresses. In the regions of the racquet frame in which the frame has a high degree of curvature, the material that exists on the outside of the frame will cover a greater distance than the material on the opposite or the inside of the frame. This can be seen in FIG. 1, wherein a standard racquetball racquet the length of the inner side of the racquet frame is significantly less than the length of the outer side of the racquet frame. This difference is most pronounced where the curvature of the racquet frame is the greatest. This difference in surface length causes the material on the inside of the frame to bunch or crease. This bunching or creasing, which is the unintended and random result of the manufacturing process, will cause wrinkles to form in materials on the inside of the frame, creating areas of weakness and undesired flexibility, as well as inconsistencies in strength and stiffness, in the frame. The creases, wrinkles or bunching that occurs in the inner side of the racquet can be seen in prior art FIGS. 2–3, which show a frame made out of laminations of fibrous material in a resin matrix, per conventional manufacture. As shown in these figures, creases, bunches or wrinkles 120 in the inner side 112 of a racquet frame 102 occur intermittently, causing various weak portions in the racquet frame. The resulting weaknesses, undesired flexibility, and inconsistencies in strength and stiffness, can affect the overall performance of the racquet and can also lead to a cracking or breaking of the racquet frame.

Therefore, it is desirable to develop a racquet frame that reduces or minimizes the incidence of bunches, creases and wrinkles formed on the inside of the racquet frame and proximate areas of curvature of the frame.

SUMMARY OF THE INVENTION

The invention provides for a sports racquet (such as ones used in squash, racquetball, badminton and tennis) including a handle and an elongated frame coupled to the handle. The frame includes a head portion, sometimes a shaft portion, and a throat portion, with the throat portion connecting the head portion to the shaft or handle. An inner side includes a plurality of undulations formed into the racquet that result in a varying frame cross section at different portions along the racquet frame. These undulations result in a longer inner side surface length, making the linear distance on the inner side of the frame more similar to the linear distance on the outer side of the frame for a particular frame segment. The undulations can be used continuously or intermittently inside the frame. A different number and variety of undulations can also be used. The undulations may be varied in frequency, height, length, depth, and shape. The present invention has application to racquets formed from any of a variety of materials including composites and metals.

It is therefore an advantage of the invention to provide a sports racquet that is formed so as to reduce or minimize the number of areas of weakness, undesired flexibility and inconsistencies in strength on the racquet frame.

It is as yet another advantage of the present invention to provide a sports racquet that has an increased overall strength in the racquet frame.

It is still another advantage of the present invention to provide a sports racquet that has a predictable level of strength and stiffness in the frame.

It is yet another advantage of the invention to provide a sports racquet wherein the frame has a more consistent weight and balance.

It is finally another advantage of the invention to provide a sports racquet that has an increased level of durability for a given amount of material and weight in the racquet frame.

Further advantages and features of the present invention will be apparent from the foregoing specification and claims once considered in connection with the accompanying drawings illustrating the preferred embodiment of the present invention.

DETAILED DESCRIPTION OF THE INVENTION

Figure 1:
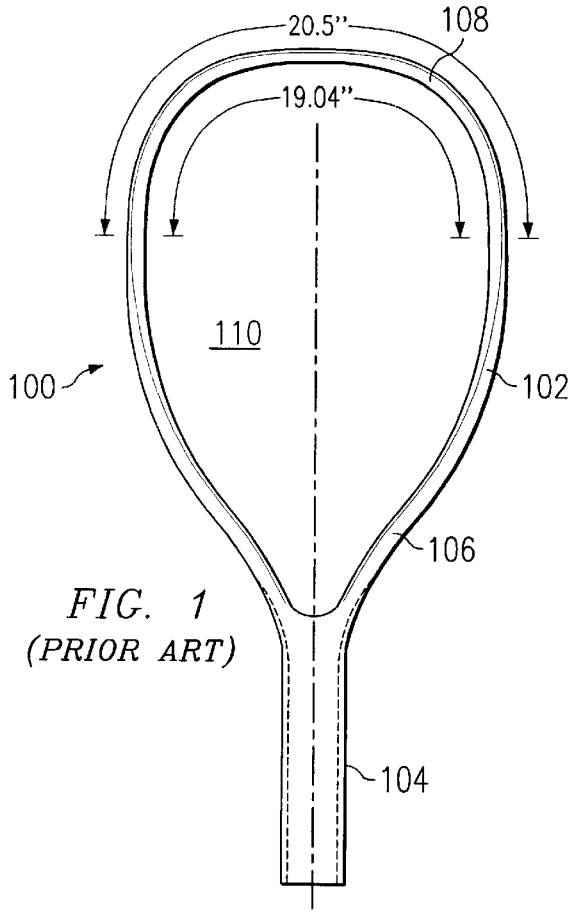
FIG. 1 (PRIOR ART)
FIG. 1 is a plan view of a racquetball racquet according to the prior art.

A sports racquet, shown generally at 100 in FIG. 1, includes a frame 102 and a handle 104 coupled to the frame 102. The racquet frame 102 includes a throat portion 106 and a head portion 108. The head portion 108 is peripheral to the hitting area 110 in which a string bed (not shown) is installed for hitting a ball (not shown). The racquet 100 can have many different shapes, with the shape depending upon the sport for which the racquet is used. For example, the racquet 100 shown in FIG. 1 would generally be intended for racquetball. A tennis racquet or badminton racquet may have a shaft (not shown) connecting the handle to the frame, and such a racquet may also have a differently shaped head 108.

Figure 3:
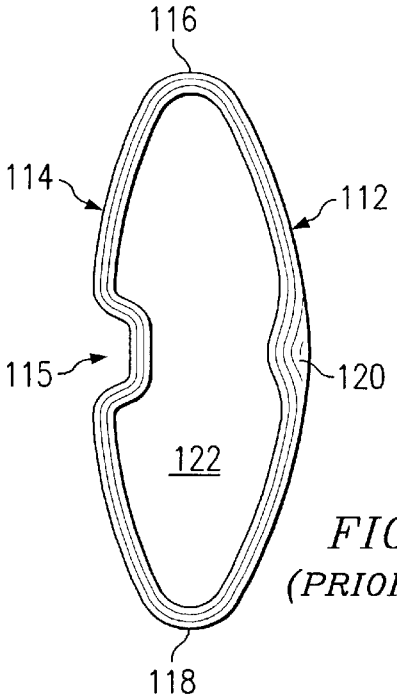
FIG. 3 (PRIOR ART)
FIG. 3 is a side view of a cross section of the racquet frame taken substantially along line 3—3 of FIG. 2.

As shown in FIG. 3, the outer side 114 of the racquet frame 102 includes a channel 115 located generally in the center of the outer side 114. The channel 115 is used for the placement of the strings used in the string bed that is connected to the racquet frame 102. A plastic retaining piece (not shown) may be inserted into the channel 115 to protect the strings and to prevent the strings from abrading and breaking over time.

Figure 2:
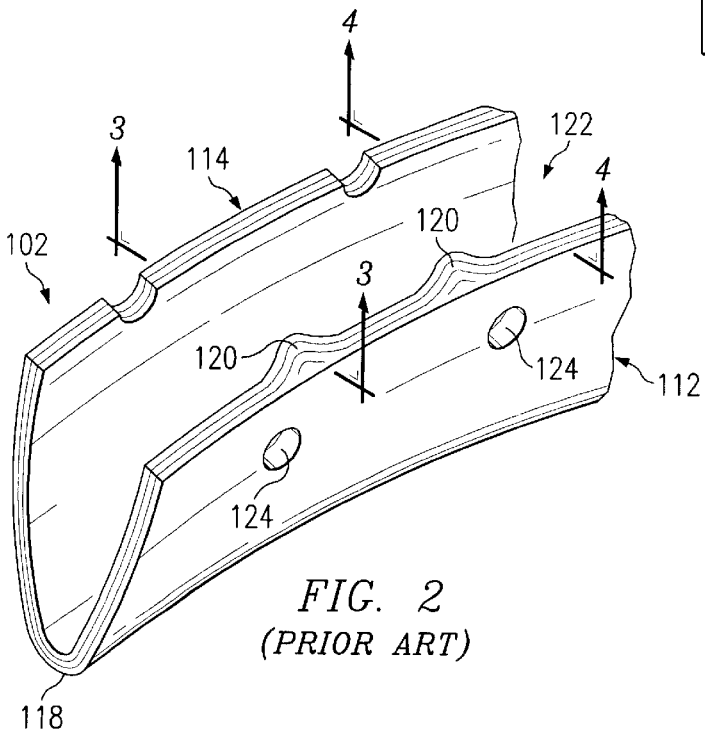
FIG. 2 (PRIOR ART)
FIG. 2 is a sectional side view of a portion of a sports racquet frame according to the prior art.
Figure 4:
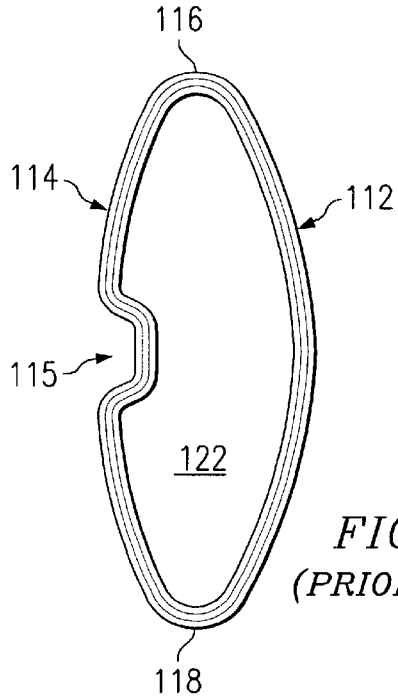
FIG. 4 (PRIOR ART)
FIG. 4 is a side view of a cross section of the racquet taken substantially along line 4—4 of FIG. 2.

As can be seen in FIGS. 2 and 3 according to the prior art, a racquet 100 often develops creases, wrinkles or bunches 120 of fibrous plies of material along the inner side 112 of the racquet frame 102 during manufacture. This is due to the distance along the inside of the racquet frame 102 being less than the distance on the outside of the frame 102, resulting in some excess material on the inside of the frame. The excess material collects in certain regions, forming ceases or wrinkles 120 along the inside side 112 of the frame 102. This material can even collect along the upper or lower sides 116 or 118 which connect the inner side 112 to the outer side 114. Some regions of the racquet frame 102 will develop creases or wrinkles 120 while other regions will not. It is difficult to predict where the creases or wrinkles 120 will occur. These ceases or wrinkles 120 may or may not correspond to the holes 124 through which the strings are connected to the frame 102, and the creases or wrinkles may or may not be evenly spaced through the frame 102. In general, the greater degree of curvature, the greater the number and severity of creases or wrinkles will occur. FIG. 4 shows a cross section of a prior art racquet taken at a point where wrinkles or creases have not accumulated. This is the desired condition throughout the frame, but does not occur uniformly in prior art racquets.

Figure 5:
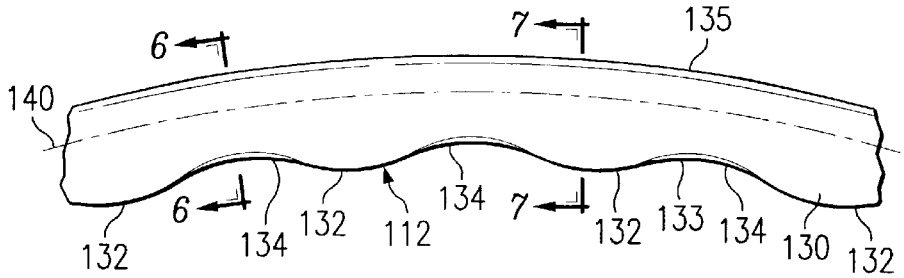
FIG. 5 is a plan view of a portion of a racquet frame according to one embodiment of the invention.
Figure 6:
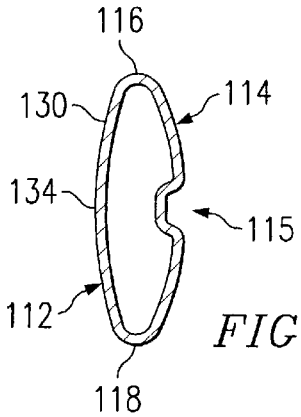
FIG. 6 is a cross-sectional view of the racquet taken substantially along line 6—6 of FIG. 5.
Figure 7:
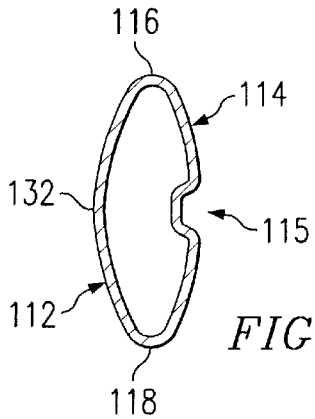
FIG. 7 is a cross-sectional view of the racquet taken substantially along line 7—7 of FIG. 5.

As shown in FIGS. 5–8, the occurrence of creases, wrinkles or bunches is reduced or minimized through the molding of undulations 130 into the inner side 112 of the racquet frame 102. FIG. 5 shows a plan view of a portion of the racquet frame 102. For the purposes of this discussion, the undulations 130 are measured by their distance from a reference line 140 that runs through the racquet frame 102. Each of the undulations 130 has an undulation peak 132 and an undulation valley 134. In the illustrated embodiment, the undulation peaks 132 and undulation valleys 134 relative to the reference line 140 alternate in the racquet frame 102. Upper and lower sides 116 and 118 connect the inner and outer sides 112 and 114 to each other. The presence of undulations 130 add to the surface length along interior center line 133 (FIG. 5), making it more similar in length to exterior center line 135 than would otherwise exist.

Figure 8:
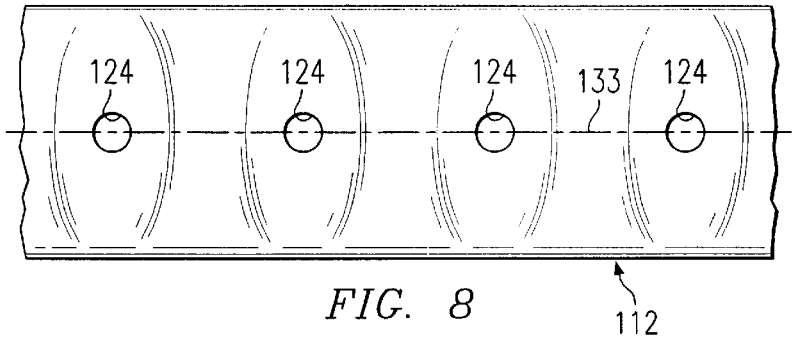
FIG. 8 is a view of a top portion of the racquet of FIG. 5, looking outward from the center of the frame.
Figure 9:
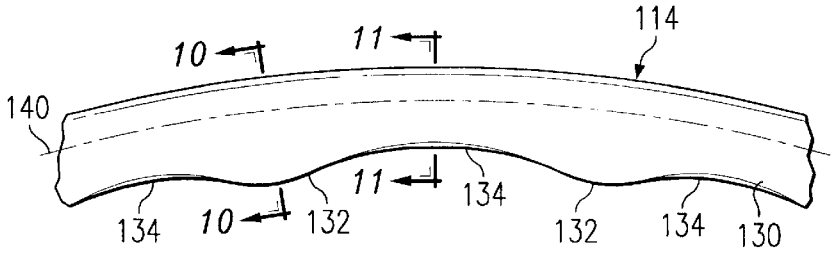
FIG. 9 is a plan view of a portion of a racquet frame according to another embodiment of the invention.
Figure 10:
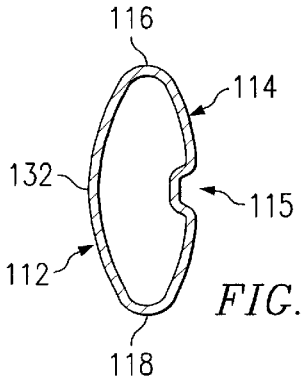
FIG. 10 is a cross-sectional view of the racquet taken substantially along line 10—10 of FIG. 9.
Figure 11:
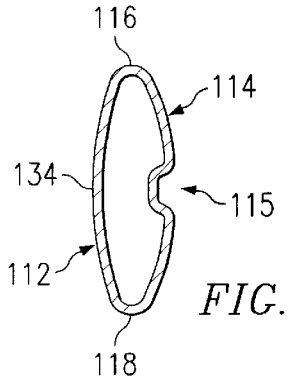
FIG. 11 is a cross-sectional view of the racquet taken substantially along line 11—11 of FIG. 9.
Figure 12:
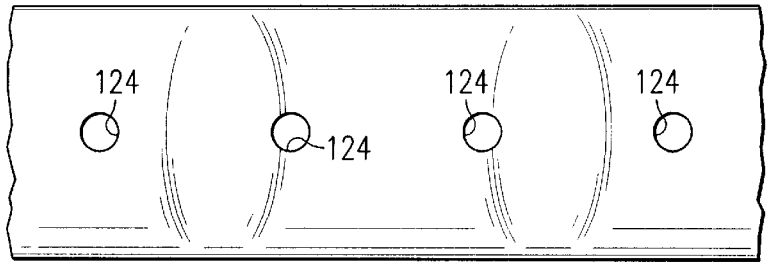
FIG. 12 is a view of the racquet of FIG. 9, looking outward from the center of the frame.
Figure 13:
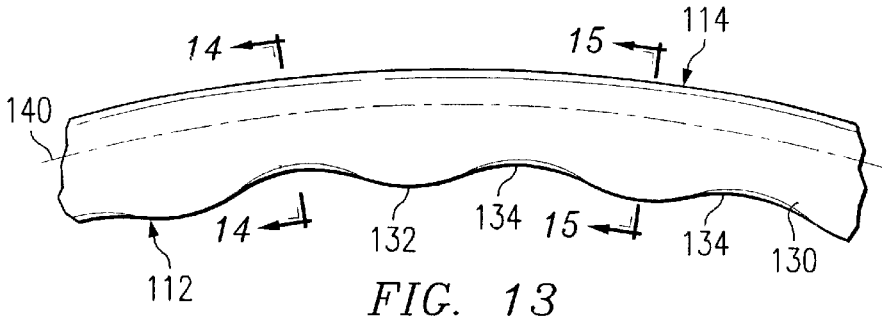
FIG. 13 is a plan view of a portion of a racquet according to another embodiment of the invention.
Figure 14:
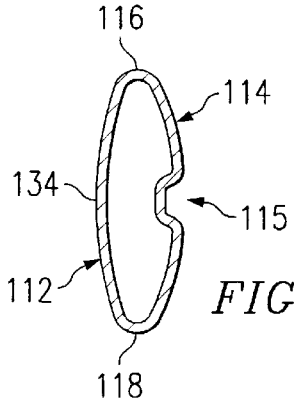
FIG. 14 is a cross-sectional view taken substantially along line 14—14 of FIG. 13.
Figure 15:
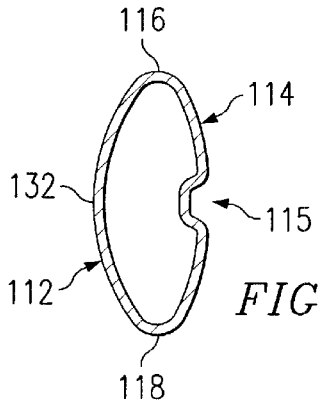
FIG. 15 is a cross-sectional side view taken substantially along line 15—15 of FIG. 13.
Figure 16:
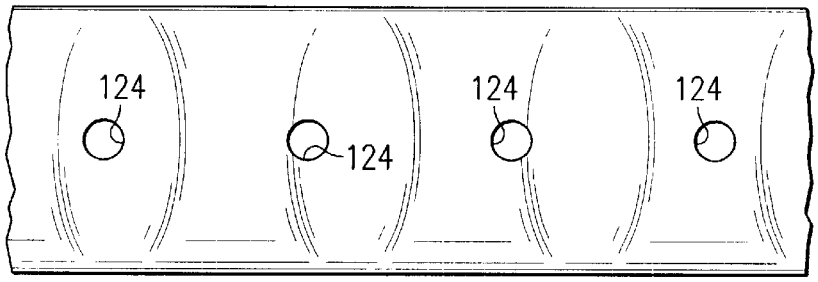
FIG. 16 is a view of the racquet of FIG. 13, looking outward from the center of the frame.
Figure 17:
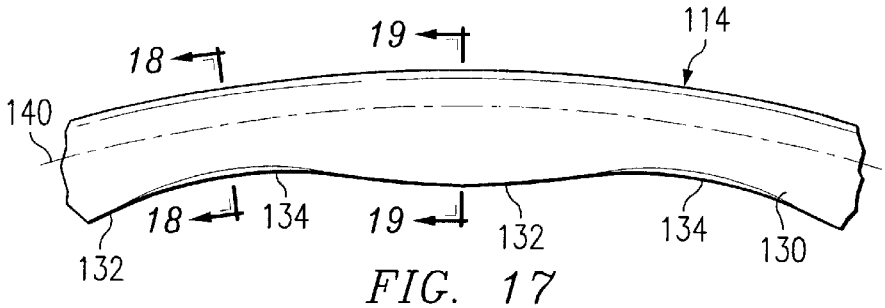
FIG. 17 is a plan view of a portion of a racquet according to another embodiment of invention.
Figure 18:
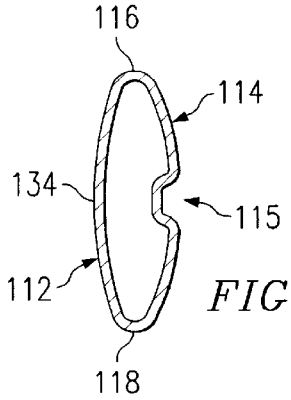
FIG. 18 is a cross-sectional view taken substantially along line 18—18 of FIG. 17.
Figure 19:
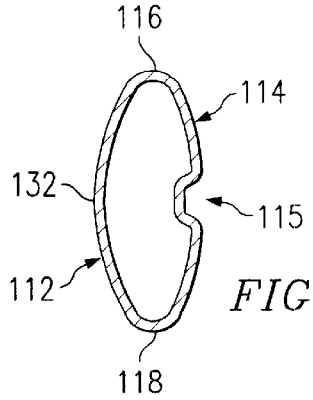
FIG. 19 is a cross-sectional view taken substantially along line 19—19 of FIG. 17.
Figure 20:
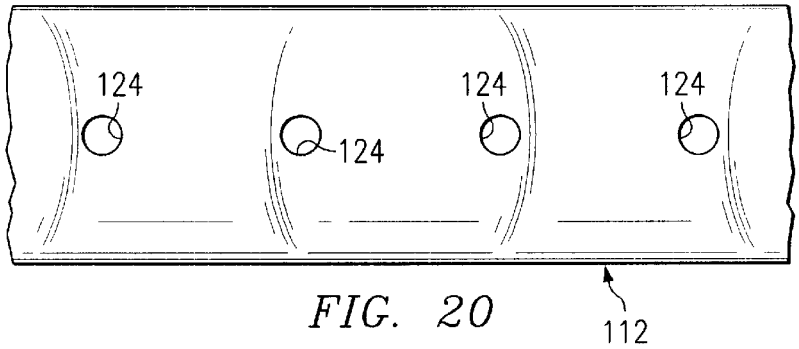
FIG. 20 is a view of the racquet of FIG. 17, looking outward from the center of the frame.
Figure 21:
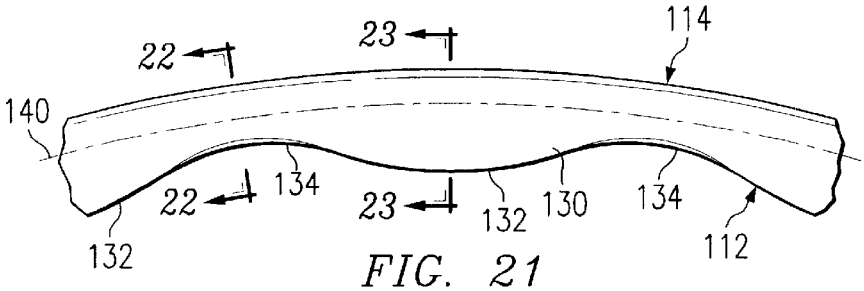
FIG. 21 is a plan view of a portion of a racquet according to yet another embodiment of the invention.
Figure 22:
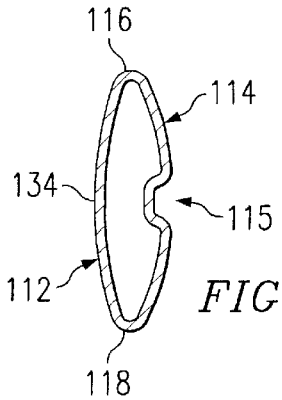
FIG. 22 is a cross-sectional view taken substantially along line 22—22 of FIG. 21.
Figure 23:
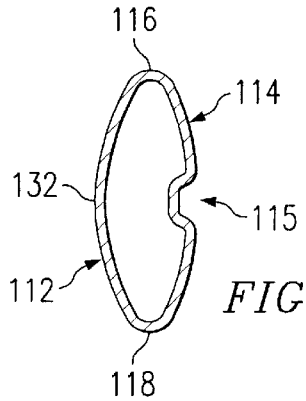
FIG. 23 is a cross-sectional view taken substantially along line 23—23 of FIG. 21.
Figure 24:
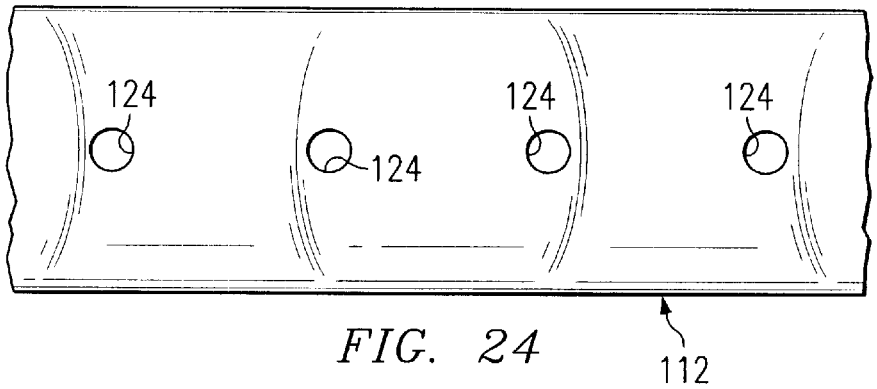
FIG. 24 is a view of the racquet of FIG. 21, looking outward from the center of the frame.
Figure 25:
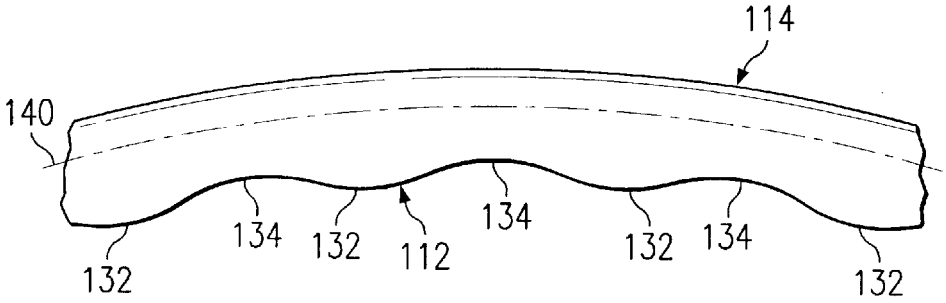
FIG. 25 is a plan view of a portion of a racquet frame according to still another embodiment of the invention.

As shown in FIG. 8, the holes 124 through which the racquet strings are threaded can align with the undulations 130. For example, in FIG. 8 each of the holes 124 line up with a respective undulation peak 132 of the racquet frame 102. It is also possible, however, for the holes to line up with the undulation valleys 134 or not to line up exactly with either the undulation peaks or valleys 132 or 134.

In the embodiment shown in FIGS. 5–8, the difference in height between undulation peaks 132 the undulation valleys 134 of the racquet frame 102 is fairly modest. This design element can be adjusted, however, to make for a greater difference between the undulation peaks and valleys 132 and 134 respectively. Furthermore, the distance between consecutive peaks or valleys in the undulations can also be adjusted in the design. For example, in FIG. 5 the lateral distance between undulation peaks 132 is of a set amount that can either be shortened or extended. It is also possible for the distance between consecutive undulation peaks 132 to be irregular.

Preferably, in order to reduce unintended creasing, bunching or wrinkling in the racquet, undulations 130 are molded into the racquet 100 at those locations where there is a substantial amount of curvature in the frame 102. For example, that portion of the frame 102 located in a particular quadrant of the racquet 100 would have at least one and a half undulations 130 in that quadrant, with an undulation defined as that portion of the racquet from one undulation peak 132 to the next undulation peak 132. For this purpose, "quadrant" is defined as any portion of the frame member that subtends an arc of ninety degrees relative to the center of the racquet frame 102.

FIGS. 9–12 show an alternative embodiment of the invention, wherein the undulations are much longer than the undulations in the embodiment shown in FIG. 5. By comparing FIGS. 5–8 with FIGS. 9–12, it is apparent that it is possible to adjust the undulation length while keeping the height of the undulation peaks and valleys 132 and 134 relative to the reference line 140 at the same distance or vice versa.

FIGS. 13–24 show other embodiments of the invention. These embodiments represent a number of different ways in which the undulation height or undulation length can be varied in order to change the contours of the frame.

Figure 28:
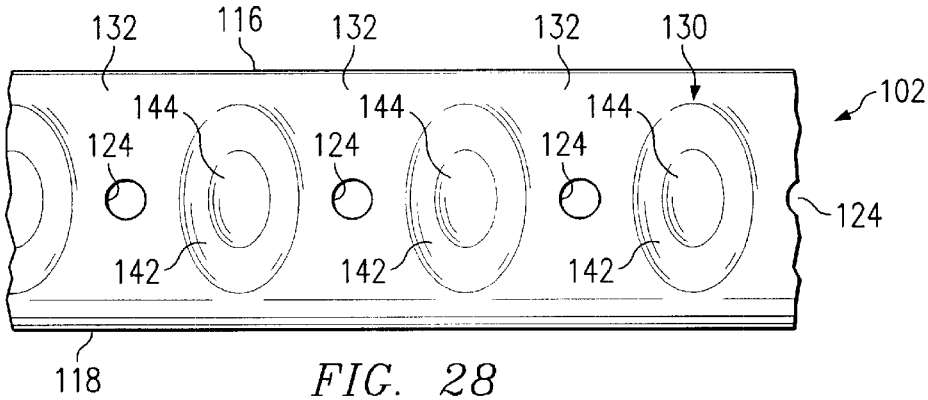
FIG. 28 is a view looking at the interior surface of the racquet portion shown in FIG. 27.

FIGS. 25–36 show several different embodiments of the invention showing the many different varieties of racquet frames 102 that can be formed using different types of undulations. For example, the undulations 130 in FIG. 26 extend across the inner side 112 from the upper side 116 to the lower side 118 of the racquet frame 102. As shown in FIG. 28, however, the undulations 130 do not have to extend from the upper side 116 to the lower side 118. This makes the undulations 130 appear more like dimples in the racquet frame 102. Furthermore, as shown in FIG. 28, it is also possible to have undulations or dimples 130 of varying depths relative to the reference line 140 of racquet frame 102. For example in FIGS. 27–28 the deepest portions 144 of the undulations 130 are substantially equidistant from the upper and lower sides 116 and 118. Outside of the deepest point 144 is a secondary region 142 that is more shallow than the deepest point 144 but still deeper than regions outside of the undulations 130.

Figure 29:
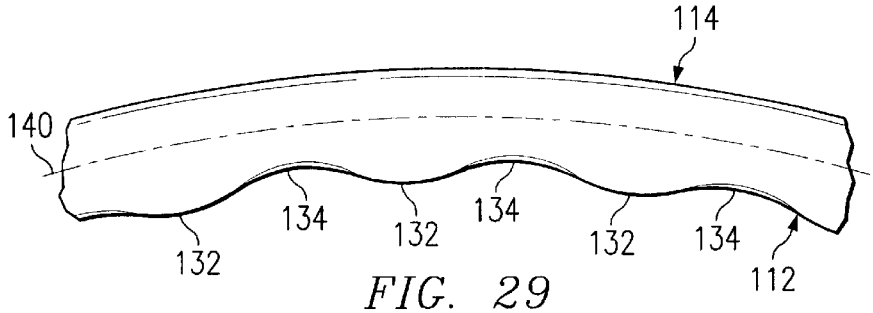
FIG. 29 is a plan view of a portion of a racquet frame according to still another embodiment of the invention.
Figure 30:
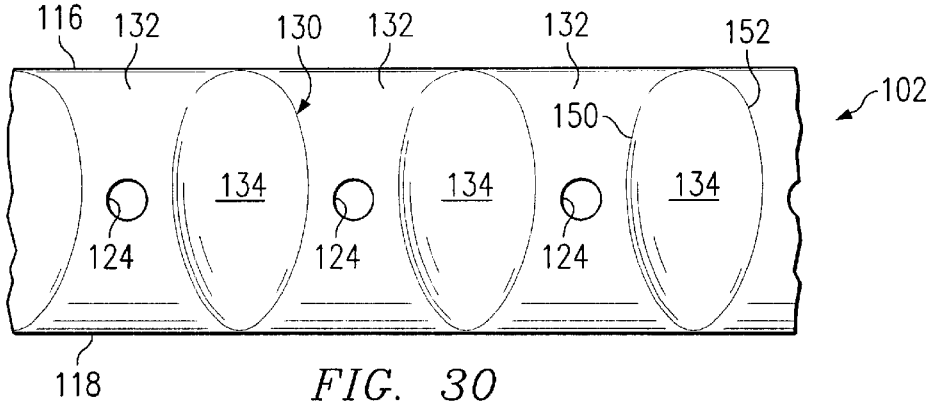
FIG. 30 is a view looking at the interior surface of the racquet portion shown in FIG. 29.
Figure 31:
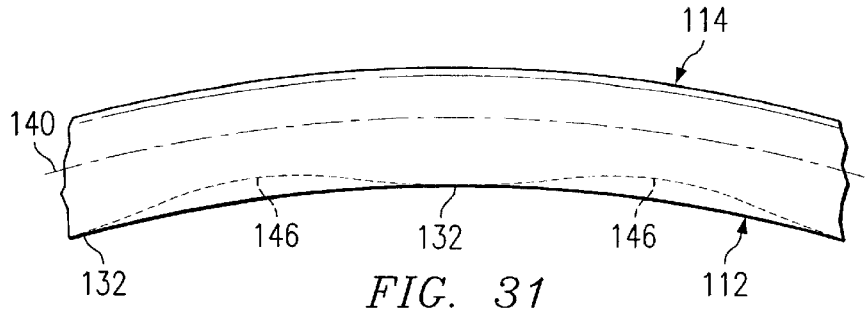
FIG. 31 is a plan view of a portion of a racquet frame according to still another embodiment of the invention.
Figure 37:
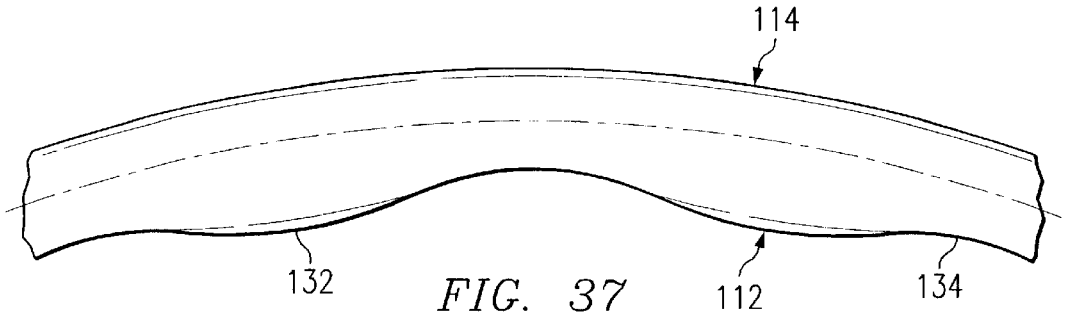
FIG. 37 is a plan view of a portion of a racquet according to a preferred embodiment of the invention.
Figure 38:
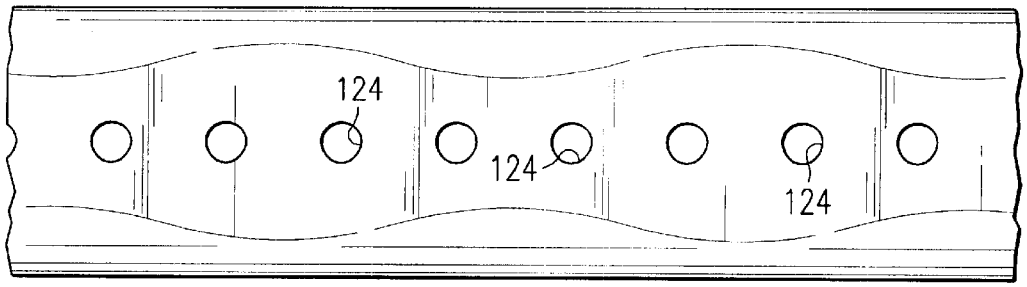
FIG. 38 is a view looking at the interior surface of the racquet portion shown in FIG. 37.

As shown in another embodiment of the invention in FIGS. 29 and 30, it is also possible to have undulations 130 of varying widths. For example, in FIG. 30 the distance from the left edge 150 of the undulation 130 to the right edge 152 of the undulation 130 varies from the upper side 116 to the lower side 118 of the frame. This is in contrast to the frame shown in FIGS. 33 and 34 where each undulation 130 has a substantially constant width. A particularly preferred embodiment of the invention is shown in FIGS. 37 and 38. The "dimple" embodiments shown in FIGS. 27–32 and 37–38 take into account that as one proceeds downwardly or upwardly from the string bed plane, many frame member cross sections will have a tendency to curve away. As one proceeds to the topmost or bottommost sides 116 or 118, therefore, the side length increases, becoming more like the external side length 114 of the frame member. The amount of undulation or dimpling therefore may need to be less to obtain the same amount of wrinkle or crease correction.

Figure 32:
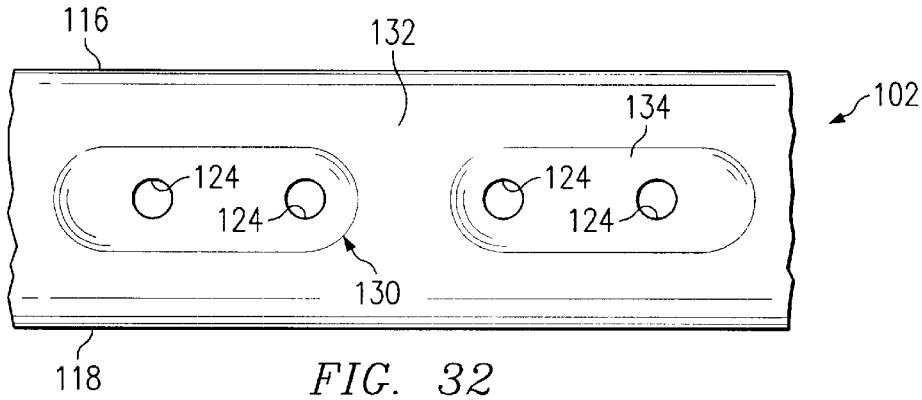
FIG. 32 is a view looking at the interior surface of the racquet portion shown in FIG. 31.
Figure 33:
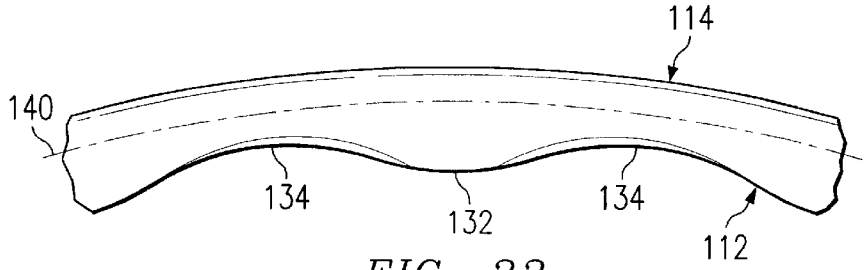
FIG. 33 is a plan view of a portion of a racquet frame according to still another embodiment of the invention.
Figure 34:
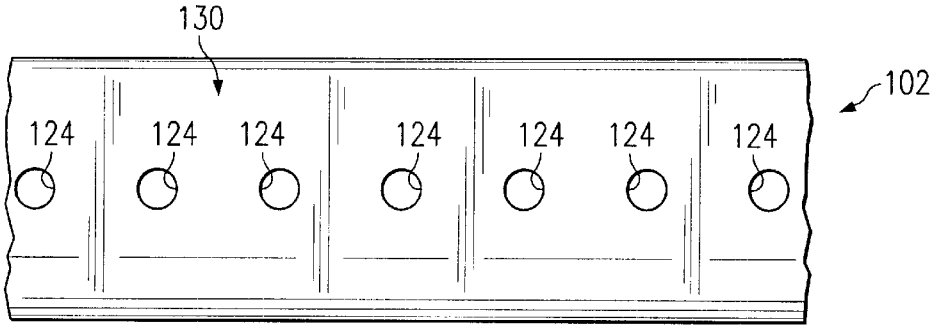
FIG. 34 is a view looking at the interior surface of the racquet portion shown in FIG. 33.
Figure 35:
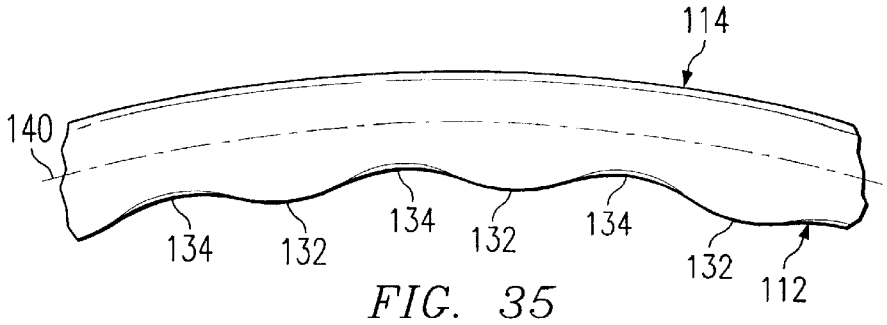
FIG. 35 is a plan view of a portion of a racquet frame according to still another embodiment of the invention.
Figure 36:
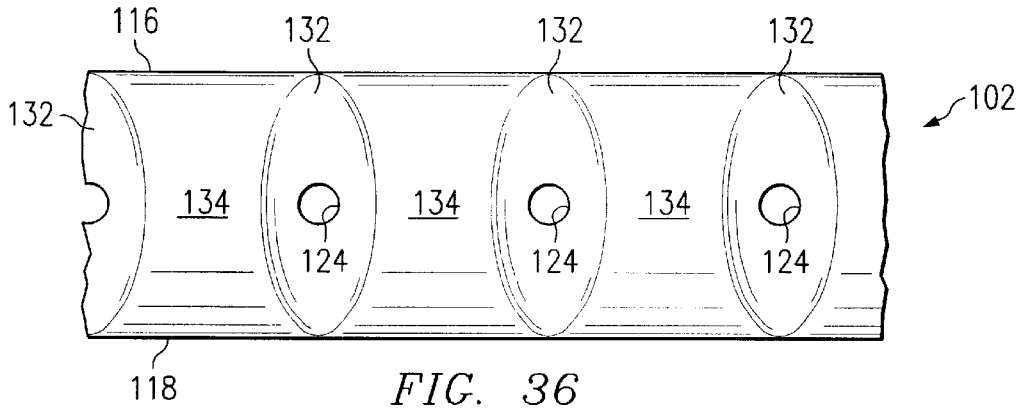
FIG. 36 is a view looking at the interior surface of the racquet portion shown in FIG. 35.

It is also possible for the undulations 130 to have other shapes. For example in FIG. 32 the undulations 130 are more oval in shape and run substantially parallel to the upper and lower sides 116 and 118 respectively. Using these types of undulations 130 it is possible to have the holes 124 for the string bed located within the undulations 130. Furthermore, as shown in FIGS. 33 and 34 it is possible to have some holes 124 located in the undulations 130 while other holes 124 located outside of the undulations 130.

In addition to the foregoing, it is possible to have many different types of undulation orientations in the same racquet 100 while still practicing the invention. For example, it is possible to alter the undulation length or undulation height. Furthermore, it is also possible to have undulations 130 of various shapes. Additionally any of these variables could be altered depending upon particular concerns such as the curvature at a particular point of the racquet head 108. For example, in FIG. 1 the head portion 108 substantially opposite the handle 104 has very little curvature and may not require many undulations 130 in order to reduce or minimize any undesired creasing, wrinkling or bunching of material. The left and right sides or "corners" of the racquet head 108 are much more curved, however, potentially requiring more undulations 130 in order to reduce creasing, bunching and wrinkling in those regions and the throat portion if desired.

Figure 26:
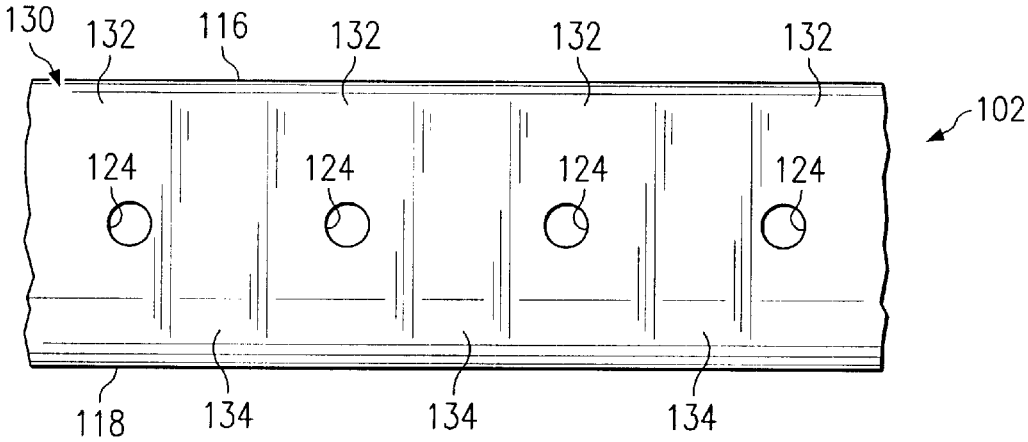
FIG. 26 is a view looking at the interior surface of the racquet portion shown in FIG. 25.
Figure 27:
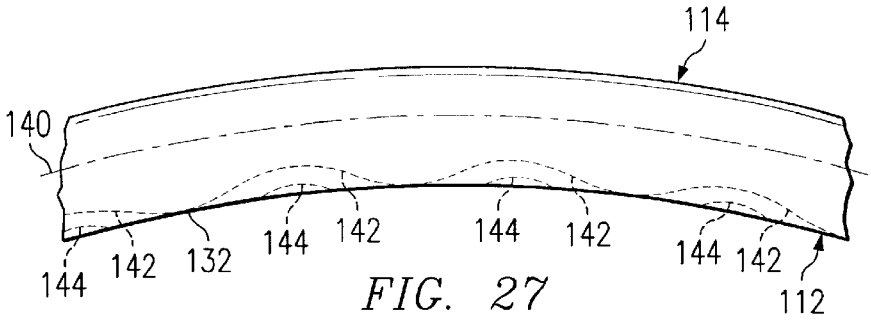
FIG. 27 is a plan view of a portion of a racquet frame according to still another embodiment of the invention.
Figure 39:
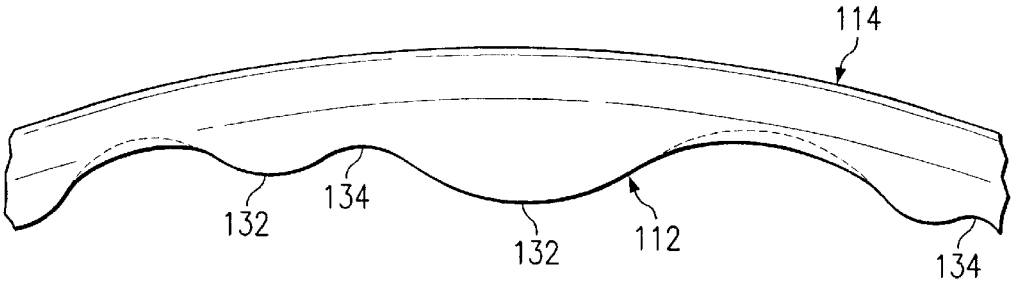
FIG. 39 is a plan view of a racquet frame portion according to an alternate embodiment of the invention, wherein the undulation length, height, and frequency are altered within a single racquet portion.
Figure 40:
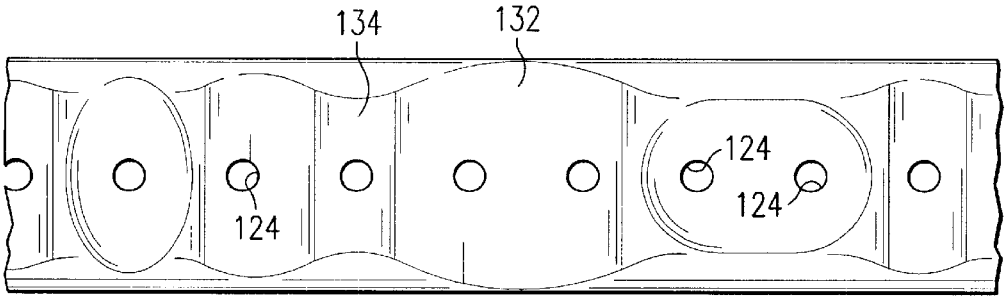
FIG. 40 is a view of the racquet portion shown in FIG. 39, looking at the interior surface of the racquet frame.

It is also possible to use different types and styles of undulations 130 in the same racquet. For example, it may be desirable to have oval shaped undulations 130, as shown in FIG. 32, in some portions of the frame 102 while having more uniformly shaped undulations 130, as shown in FIG. 26, in other regions. Also, it may be desirable to have the undulations taper to different degrees, either from racquet to racquet or in the same racquet itself. As shown in detail in FIGS. 39 and 40, it is even possible to alter each of these variables in a single racquet portion.

Figure 41:
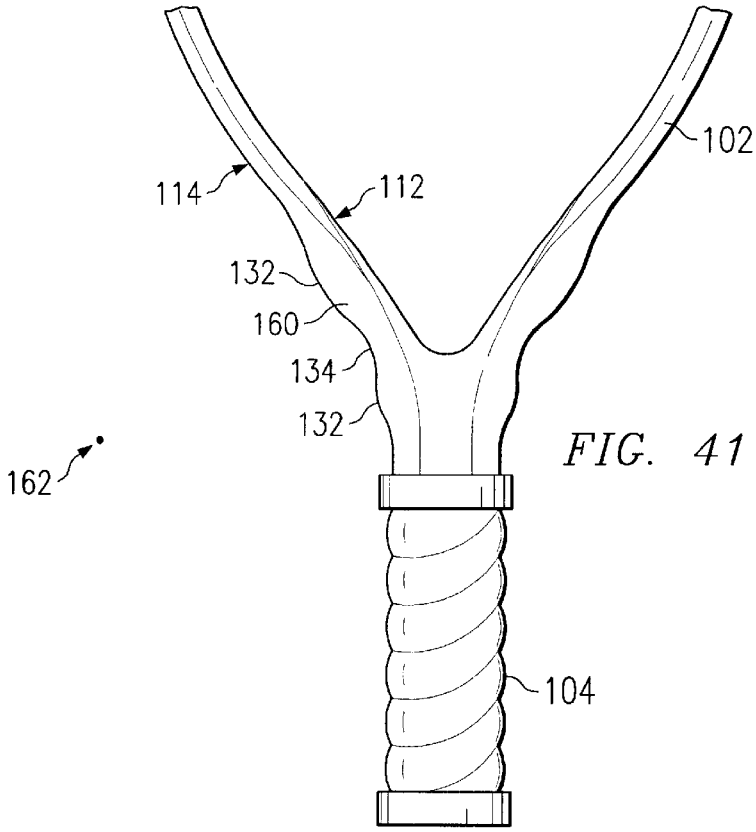
FIG. 41 is a plan view of a portion of a racquet with undulations in the handle region.

Although it is often desirable to have undulations 130 formed on the inner side 112 of the head portion 106 of the frame 102, it is possible to include undulations 130 on other portions of the racquet 100, so long as that particular portion of the racquet curves around a particular center point. For example, the portion 160 of the racquet that connects the frame 102 to the handle 104 curves about a center point 162 that is located outside of the racquet 100, as shown in FIG. 41. With the portion 160 curving about the exterior center point 162, any bunching or wrinkling that occurs is likely to be more pronounced on the outer portion 114 of the racquet 100 than on the inner portion 112. It is therefore possible to include undulations 130 on the outer portion 114 of the racquet 100 in this case. As is the case with undulations 130 located in other regions of the racquet 100, the undulation height, length, frequency, and other variables can also be modified in light of certain manufacturing and performance considerations.

Figure 43:
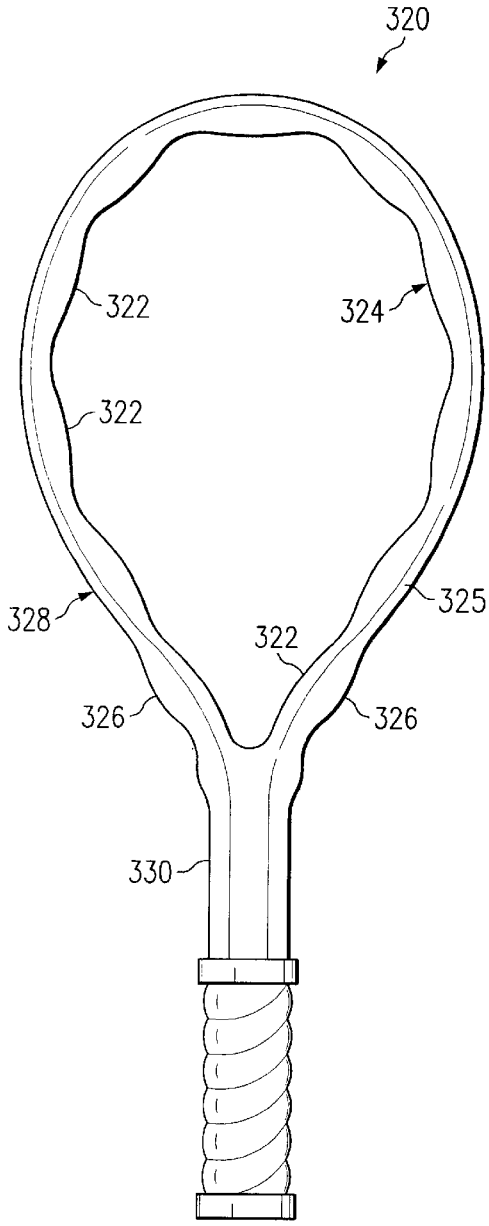
FIG. 43 is a plan view of a shafted racquet frame incorporating the invention.
Figure 44:
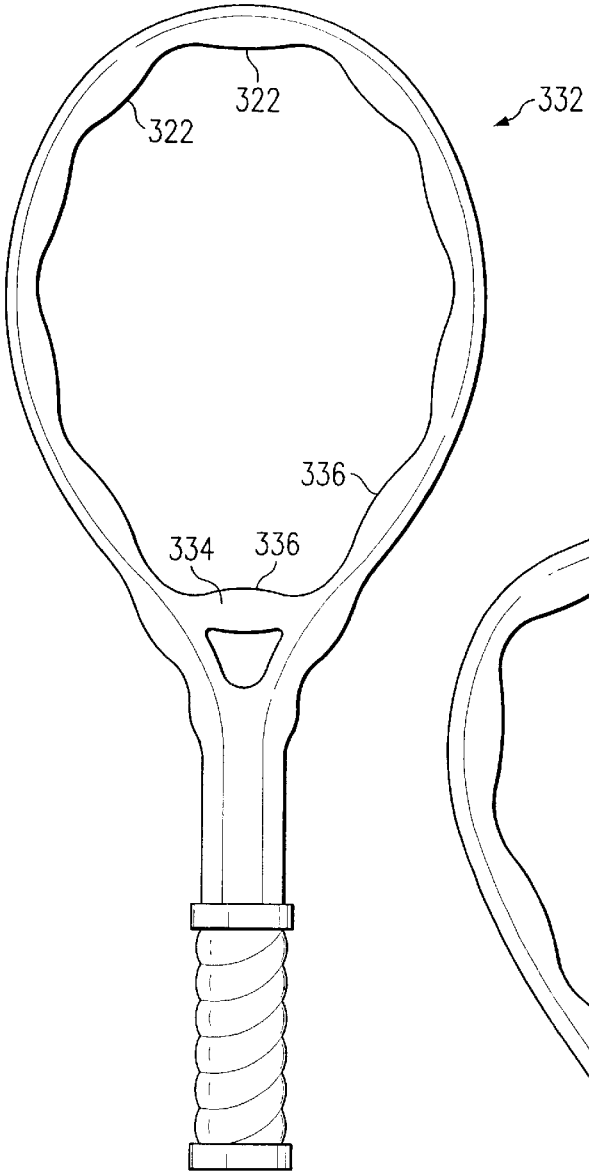
FIG. 44 is a plan view of a second shafted racquet frame incorporating the invention, the frame having a throat piece.

The present invention has application to both shafted and nonshafted sports racquets. FIGS. 43 and 44 are plan views of shafted sports racquets, of the kind which may be used in tennis, squash or badminton. In racquet 320 shown in FIG. 43, undulations 322 are formed substantially throughout the entire inner surface 324 of the frame 325, while a few undulations 326 are formed on an outer surface 328 of the frame in the region of frame 325's curved junction with shaft 330. Because there are no relatively sharp "corners" in a head portion of frame 325, the undulations 322 are more evenly distributed to more evenly provide their function of increasing the length of the frame 325's interior surface.

In FIG. 44, a shafted racquet 332 has a throat piece 334.

Undulations 336 are formed in the interior surface of the throat piece 334 to reduce creasing or wrinkling in that area. Undulations 322 and 326 are employed elsewhere as in racquet 320.

Figure 45:
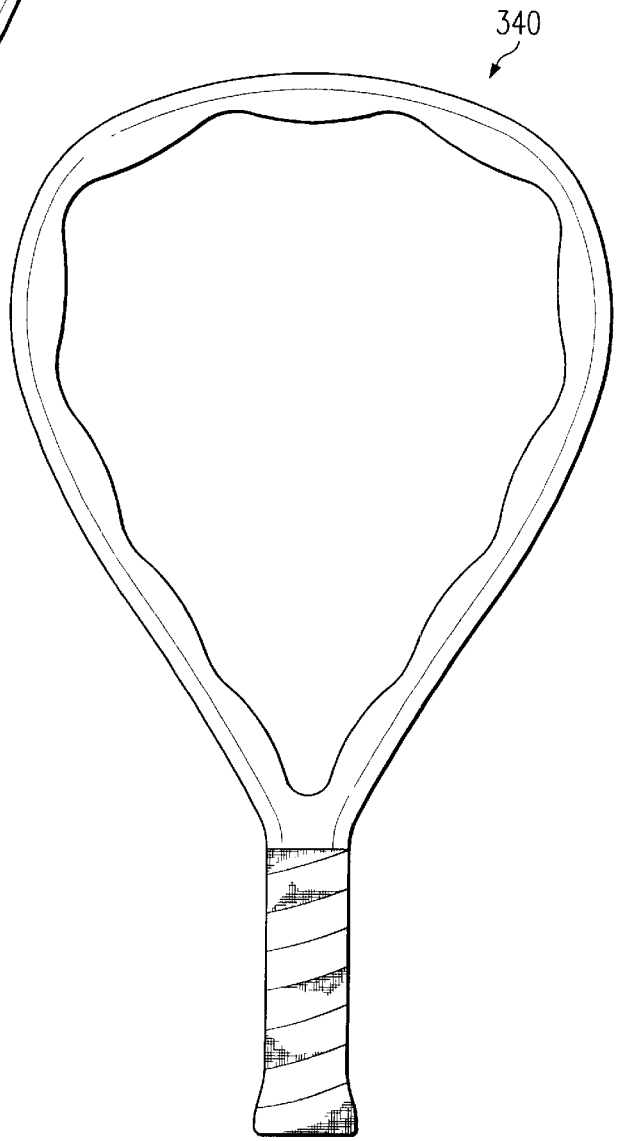
FIG. 45 is a plan view of a nonshafted racquet frame incorporating the invention.

FIG. 45 shows a nonshafted racquet 340 having undulations 342 distributed throughout the circumference of the internal surface of its frame 344.

It is possible for the racquet frame 102 to be made of several different materials. In a preferred embodiment of the invention, a material such as keviar, boron, carbon, fiberglass, aramid, metal fibers, ceramics or graphite may be especially useful, not only for improving the overall functionality of the racquet but also for forming the undulations during the manufacturing process. It is possible, however, for other materials such as aluminum to be used while still taking advantage of the wrinkle-reducing undulation concept.

Figure 42:
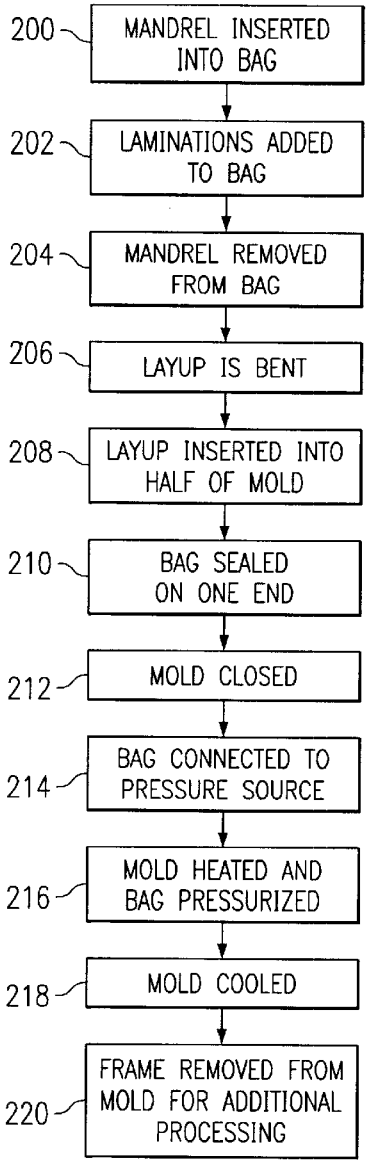
FIG. 42 is a block diagram of an exemplary racquet molding process according to the invention.

Composite sports racquets according to the invention may be manufactured according to the following exemplary process as described in FIG. 42. An elongate, flexible mandrel is first inserted into a similarly elongate and flexible, relatively gas-impermeable and heat-resistant bag made from materials known in the art, shown at 200. Several laminations of material are added to the outside of the bag surface at 202. These pieces of material may and usually do differ one from another in size, shape, composition and fiber orientation. Preferably, they are preimpregnated with resin.

Once the material has been wrapped to the bag surface, the mandrel is removed from an open end of the bag, shown at 204. The bag, including the laminations of material (collectively known as a "layup"), is bent into a shape that approximates the future frame member, shown at 206, and is inserted into one-half of a mold, shown at 208. It is this bending step that creates the wrinkles or bunching in the material. But in the present invention, and unlike in prior processes, the mold is constructed to have undulations in its surface which are the negative of the undulations to be formed in the surface of the frame member. The bag is sealed at one end at step 210. An upper half of the mold is fixed to the lower half of the mold to enclose the layup, shown at 212.

A source of pressurized gas is used to inflate the bag to a high pressure such as 100 to 300 pounds per square inch, as shown in 214. This forces the laminations of material against the mold walls. The laminations of the material will be forced against the mold undulations (at those locations where undulations are to be formed), and in being forced to this position many of the wrinkles in the laminations will diminish or disappear. The closed and inflated mold is then subjected to heat sufficient to cause the impregnated resin to flow, bonding the laminated materials together and forming the frame member, shown at 216. After cooling the mold, shown at 218, the member is removed and finished by removing flash, painting, etc, shown at 220.

Other manufacturing processes may be used to obtain the same result, i.e., undulations formed on an inner side of one or more curved portions of the frame. For example, instead of inflation, the mold sides may be displaced inwardly from an initial outward position by springs to impress the undulations into the layup. The laminations of the layup may be drawn outwardly to conform to the mold's negative undulations by applying a partial vacuum to the mold. A layup with a bag may be used in which the bag holds ammonia, with heating of the mold causing the ammonia to expand the bag. Foam may be used as a bag expansion agent. Finally, similar techniques can be employed without a bag.

While preferred embodiments have been shown and described, it is understood that changes and modifications can be made to the invention without departing from the invention's broader aspects. For example, the undulation length, undulation height, undulation shape and undulation frequency can be altered in numerous respects while still taking advantage of the inventions broader aspects. Also of note is the fact that the undulations can be placed at virtually any location on one side of the frame. Thus it is apparent that alternative embodiments are available to those of skill in the art therefore the present invention is not limited to the described and illustrated embodiment, but only by the scope and spirit of the independent and dependent claims.

I claim:

1. A sports racquet, comprising:

a handle;

a frame formed from a fibrous material and coupled to the handle, the frame disposed peripherally of a string bed having:

an inner portion of the frame disposed proximate to the string bed and an outer portion located substantially opposite the inner portion to be remote from the string bed, the inner portion of the frame including a plurality of undulations that extend towards and away from the string bed, no corresponding undulations being formed on the outer portion of the frame.

2. The sports racquet of claim 1, wherein the frame is a composite.

3. The sports racquet of claim 1, wherein the undulations are spaced substantially equidistantly from each other along the inner portion of the frame.

4. The sports racquet of claim 1, wherein the undulations are included substantially in the head portion of the frame.

5. The sports racquet of claim 1, wherein the racquet is a shafted racquet.

6. The sports racquet of claim 3, wherein the maximum distance between the inner and outer portions of the frame at one cross-section is of substantially the same magnitude at corresponding points in each undulation.

7. The sports racquet of claim 1, wherein the maximum distance between the inner and outer portions at a specific cross-section varies between adjacent undulations.

8. The sports racquet of claim 1, wherein the minimum distance between the inner and outer portions of a specific cross-section varies between adjacent undulations.

9. The sports racquet of claim 1, wherein a distance between the maximum and minimum distances between the inner and outer portions at a specific cross-section varies between adjacent undulations.

10. A racquet, comprising:

a frame formed from a fibrous material and having an interior surface and an exterior surface; and a string bed residing substantially in a plane;

wherein the frame intersects the string bed plane at an exterior locus and an interior locus, the exterior locus forming a smooth arc shape, and wherein the interior locus defines a plurality of undulations such that an interior linear distance formed at the intersection of the inner surface and the plane is more similar to an exterior linear distance formed at the intersection of the exterior surface and the plane than would be the case without the undulations being present.

11. The racquet of claim 10, wherein the interior locus defines a plurality of evenly spaced undulations through the inner surface of the frame.

12. The racquet of claim 11 wherein the radius of curvature of one undulation is substantially identical to the radius of curvature of each other undulation.

13. A racquet comprising:

a handle;

an endless frame of a fibrous material coupled to the handle and formed around a center, the frame divided into four quadrants each subtending an arc of ninety degrees as measured from the center, wherein at least one quadrant of the frame comprises at least one and one-half undulations on an inside surface of the frame, no corresponding undulations being formed on an outside surface of the frame quadrant opposite the undulations on the inside surface.

14. The sports racquet of claim 1, wherein the outer portion of the frame adjacent the handle includes a plurality of undulations that extend towards and away from the string bed, no corresponding undulations being formed on the inner portion of the frame.

* * * * *